US009879468B2

(12) United States Patent
Medawar

(10) Patent No.: US 9,879,468 B2
(45) Date of Patent: Jan. 30, 2018

(54) SECURITY DISPLAY CASE

(71) Applicant: Samuel C. Medawar, Lansing, MI (US)

(72) Inventor: Samuel C. Medawar, Lansing, MI (US)

( * ) Notice: Subject to any disclaimer, the term of this patent is extended or adjusted under 35 U.S.C. 154(b) by 0 days.

(21) Appl. No.: 15/237,701

(22) Filed: Aug. 16, 2016

(65) Prior Publication Data

US 2017/0167184 A1 Jun. 15, 2017

Related U.S. Application Data

(63) Continuation-in-part of application No. 15/016,901, filed on Feb. 5, 2016, and a continuation-in-part of application No. 14/966,092, filed on Dec. 11, 2015, now Pat. No. 9,512,663.

(51) Int. Cl.

| | |
|---|---|
| ***E05G 1/04*** | (2006.01) |
| ***A47F 3/00*** | (2006.01) |
| ***A47F 7/024*** | (2006.01) |
| ***E05B 65/00*** | (2006.01) |

(52) U.S. Cl.

CPC ..... *E05G 1/04* (2013.01); *A47F 3/002* (2013.01); *A47F 7/024* (2013.01); *E05B 65/0075* (2013.01); *E05Y 2800/426* (2013.01); *E05Y 2800/74* (2013.01)

(58) Field of Classification Search

CPC ..... E05B 65/0075; E05G 1/02; E05G 1/00; E05G 1/005; E05G 1/024; E05G 1/026; E05G 2700/02; E05G 1/04; B65D 25/22; Y10T 70/5031; E05Y 2800/74; E05Y 2800/426; A47F 3/002; A47F 7/024

USPC ..... 70/82, 121–123, 89, 90; 292/44–49, 53, 292/54, 157, 160; 109/47

See application file for complete search history.

(56) References Cited

U.S. PATENT DOCUMENTS

| | | | | |
|---|---|---|---|---|
| 5,209,168 A * | 5/1993 | Chapron | E05B 17/2084 109/59 T |
| 9,512,663 B2 * | 12/2016 | Medawar | E05G 1/04 |
| 2006/0102812 A1 * | 5/2006 | Cvek | A47B 21/007 248/125.2 |
| 2009/0217714 A1 * | 9/2009 | O' Leary | E05B 47/023 70/84 |

* cited by examiner

*Primary Examiner* — Suzanne Barrett
(74) *Attorney, Agent, or Firm* — The Weintraub Group, P.L.C.

(57) ABSTRACT

The present invention is a security display case comprising: an enclosure having a plurality of sidewalls defining a safe portion, one of the sidewalls having an opening formed therein; at least a pair of panels hingedly attached over the opening of the enclosure, at least one first locking mechanism disposed on a first panel of the at least a pair of panels and a second locking mechanism disposed on a second panel of the at least a pair of panels; a display housing moveable in and out of the safe portion of the enclosure; at least one locking assembly mounted within the enclosure to facilitate locking and unlocking the display housing within the enclosure; and a control system for operating the movement of the display housing and the locking assembly.

20 Claims, 6 Drawing Sheets

SECURITY DISPLAY CASE

CROSS-REFERENCE TO RELATED APPLICATIONS

This application is a continuation-in-part application of co-pending U.S. patent application Ser. No. 15/016,901, filed Feb. 5, 2016, for "Security Display Case," which is a continuation-in-part application of U.S. patent application Ser. No. 14/966,092, filed Dec. 11, 2015, for "Security Display Case," which is a completion application, and claims the priority benefit, of U.S. Provisional Patent Application Ser. No. 62/091,976, filed Dec. 15, 2014, for "Security Display Case," the entire disclosures of which are hereby incorporated by reference in their entirety including the drawings.

BACKGROUND OF THE INVENTION

1. Field of the Invention

The present invention relates to display cases which include a built-in storage safe. More particularly, the present invention relates to display cases which move the display structure between a security position and a display position.

2. Description of the Prior Art

Display cases are widely known for use in a variety of environments, including their use in displaying high-value articles such as jewelry, coins, watches, cameras, firearms, and the like. A typical display case has one or more glass windows and, thus, is particularly susceptible to theft when a criminal smashes the glass and removes as many valuable articles as possible before escaping.

Oftentimes, retailers will remove high-value items from their display cases at the close of business daily and relocate the merchandise into more secure storage. This routine transfer of goods between a display case and a security storage vault causes the problem of increased labor required to perform the relocation of display items at the end and beginning of a business day. Other problems include a possible wear and tear on the merchandise and display fixtures, and increased problems with inventory and loss control.

Accordingly, it would be of significant advantage to provide a security display case which would secure merchandise from possible theft without requiring the removal of the merchandise for safe storage after and between business hours. Further, secure in situ storage would protect the merchandise from fire after business hours.

Security display cases are known and typically include mechanisms for lowering a display shelf within a display case. These mechanisms oftentimes vary from motorized linear lifts to scissor jack lift assemblies. However, these devices are difficult to install in existing display cases or are difficult to use and/or unreliable over long term use. Further, some of the existing systems tend to operate very slowly and may not be effective in smash and grab daytime robberies.

Examples of apparatus related to security display cases are disclosed in Sands, EP 0521728A1 directed to a "Security Receptacle," McCabe, U.S. Pat. No. 636,449 for a "Portable Elevator," and Salter, U.S. Pat. Pub. 2007/0194674 for a "Lifting and Barrier Mechanism."

Another security display case is disclosed in U.S. Pat. No. 9,078,531 to Samuel C. Medawar, the Applicant herein, the disclosure of which is hereby incorporated by reference in its entirety, including the drawing. The display case shown therein includes a safe portion, having a pair of panels pivotally connected thereto and adapted to be pivoted by a mechanism between open and closed positions, a display housing connected to the safe portion, and a scissor-like lift mechanism mounted in the safe portion for moving a lift platform supporting items to be displayed between security and display positions.

Additionally, while each of the devices disclosed in the above prior published documents are believed to have been suitable for the uses and problems then intended to solve, there is an ongoing need for improvements in the design of security display cases, such as simpler and more compact designs providing improved ease of operation.

In the above referred to co-pending applications, there is disclosed a security display case having a safe portion and a display housing movable within the safe portion. The display housing includes a top wall and a locking mechanism disposed thereon having a linkage system of latch fingers which operate to lock the display housing within the safe portion.

The present invention seeks to improve upon the invention disclosed in the above co-pending applications by providing a simplified locking mechanism mounted within the safe portion and improved means for accessing the safe portion, such as embodied in the invention herein.

The above prior art references are identified herein in recognition of a duty of disclosure of related subject matter, which may be relevant under 37 CFR 1.56, and specifically incorporated herein by reference as regards the conventional approaches and constructions taught therein.

SUMMARY OF THE INVENTION

The present invention discloses a security display case, generally, comprising: (a) an enclosure having a plurality of sidewalls defining a safe portion, one of the sidewalls having an opening formed therein; (b) at least a pair of panels hingedly attached over the opening of the enclosure, at least one first locking mechanism disposed on a first panel of the at least a pair of panels and a second locking mechanism disposed on a second panel of the at least a pair of panels; (c) a display housing moveable in and out of the safe portion of the enclosure; (d) at least one locking assembly mounted within the enclosure to facilitate locking and unlocking the display housing within the enclosure; and (e) a control system for operating the movement of the display housing and the locking assembly.

With more particularity, and as described in co-pending U.S. patent application Ser. No. 15/016,901, the display housing is movably stowed in the safe portion for movement between a lowered security position, wherein the display housing is completely within the safe portion and the safe portion is securely sealed by the closure member, and a raised display position permitting items within the display housing to be viewed. The display housing includes a lower lift platform, a plurality of sidewalls extending upwardly from the lower lift platform, a top wall opposite the lift platform and disposed atop the sidewalls, and a lid or closure member mounted distally above the top wall.

Additionally, the display case includes a lift mechanism mounted in the safe portion, the lift mechanism being connected to the lift platform for moving the display housing between the security and display positions.

A first drive motor operates the lifting mechanism to cause the lift platform to move axially vertically between respective security and display positions.

The locking assembly includes at least one disc adapted to be rotated from an unlocked position into a locking position with the display housing when in the security position. A second drive motor is provided for rotating the at least one disc into and from locking and unlocked positions with the display housing. Preferably, a pair of locking assemblies are used and mounted on opposing sides of the safe portion. Even more preferably, each of the pair of locking assemblies includes a plurality of discs which are simultaneously rotated to engage the display housing.

The control system controls the lift mechanism and the locking assembly. The control system includes a lower limit switch and an upper limit switch that de-energizes the first drive motor, a lock and unlock trip switch that de-energizes the second drive motor, and an actuator switch connected to the first and second drive motors and positionable in either an "up" or a "down" position to selectively cause the display housing to move between the security and display positions, respectively.

The present invention further includes means for accessing the safe portion of the enclosure and a locking assembly. The opening formed within one of the sidewalls of the enclosure is preferably formed within a back wall of the enclosure. At least a pair of panels are hingedly attached to the back wall about the opening and include at least one locking assembly similar to that disclosed in the above locking mechanism that locks the display housing within the safe portion. This locking mechanism facilitates locking and unlocking the panels together against the opening formed in a back wall of the enclosure and provides access to the safe portion of the enclosure when unlocked.

As noted above, the locking assembly of the present invention provides the second drive motor is disposed proximate the lower lift platform of the safe portion, which allows the components of the locking assembly to be more easily accessed.

The present invention will be more clearly understood with reference to the accompanying drawing and to the following Detailed Description, in which like reference numerals refer to like parts and where:

DETAILED DESCRIPTION OF THE INVENTION

Figure 1:
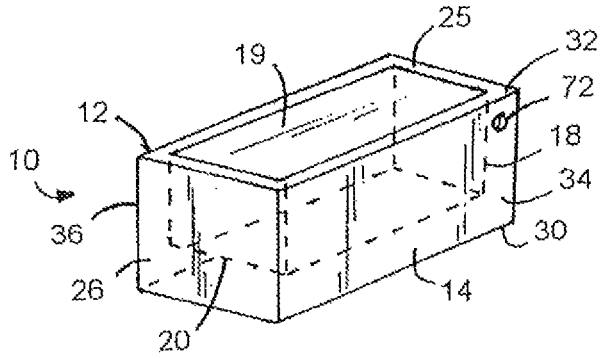
FIG. 1 is a perspective view of a security display case according to the present invention with a vertically movable display housing lowered into a lower safe portion of an enclosure.
Figure 2:
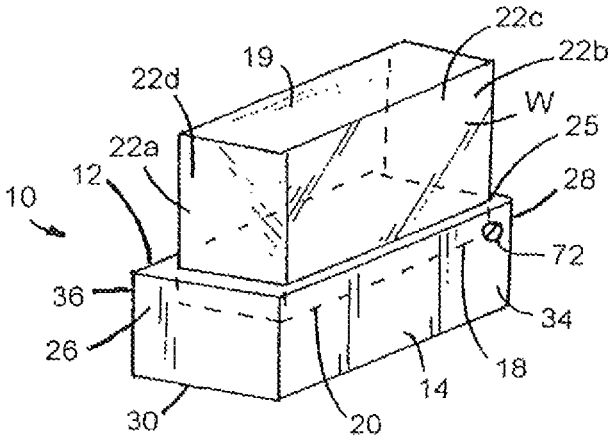
FIG. 2 is a perspective view of the display case of FIG. 1 showing the display housing raised above the enclosure and in a display position.

Turning now to the drawing, FIGS. 1-11 show a security display case 10 for easily moving items from a safe position (FIG. 1) into a display position (FIG. 2), and vice versa, when desired. A display housing 18 is raised and lowered without having to transfer the items into a remote safe for safekeeping before and after business hours.

As disclosed in co-pending U.S. patent application Ser. No.15/016,901, the security display case 10 of the present invention includes a generally rectangular-shaped enclosure 12 defining a safe portion 14, having upper and lower ends, at least one locking assembly 58 disposed within the safe portion 14 proximate the upper end, and the display housing 18 having a lower lift platform 20, a pair of laterally spaced sidewalls 22*a*, 22*c*, a front wall 22*b*, a back wall 22*d*, each of the walls 22*a*, 22*b*, 22*c*, 22*d* extending upwardly from the lower lift platform 20, a top wall 19 disposed opposite the lower lift platform 20 atop the walls 22*a*, 22*b*, 22*c*, 22*d*, and a closure member 24 mounted above the top wall 19 providing a gap 21 therebetween. The gap 21, as discussed below provides a cavity to facilitate locking the display housing 18 in the safe portion 14.

A lift mechanism (not shown) in conjunction with a first drive motor (not shown) facilitates lateral movement of the display housing 18 between the safe position and display position. The lift mechanism and first drive motor are discussed in detail in co-pending U.S. patent application Ser. No. 14/966,092.

The enclosure 12 is formed by a pair of laterally spaced sidewalls 26, 28, lower and upper walls 30, 32, and front and back walls 34, 36. The upper wall 32, lower wall 30, front wall 34, and back wall 36 extend between sidewalls 26, 28 to define the safe portion 14 for receiving or stowing the display housing 18. The upper wall 32 has a central opening 25 formed therein through which the display housing 18 extends and retracts.

Figure 3:
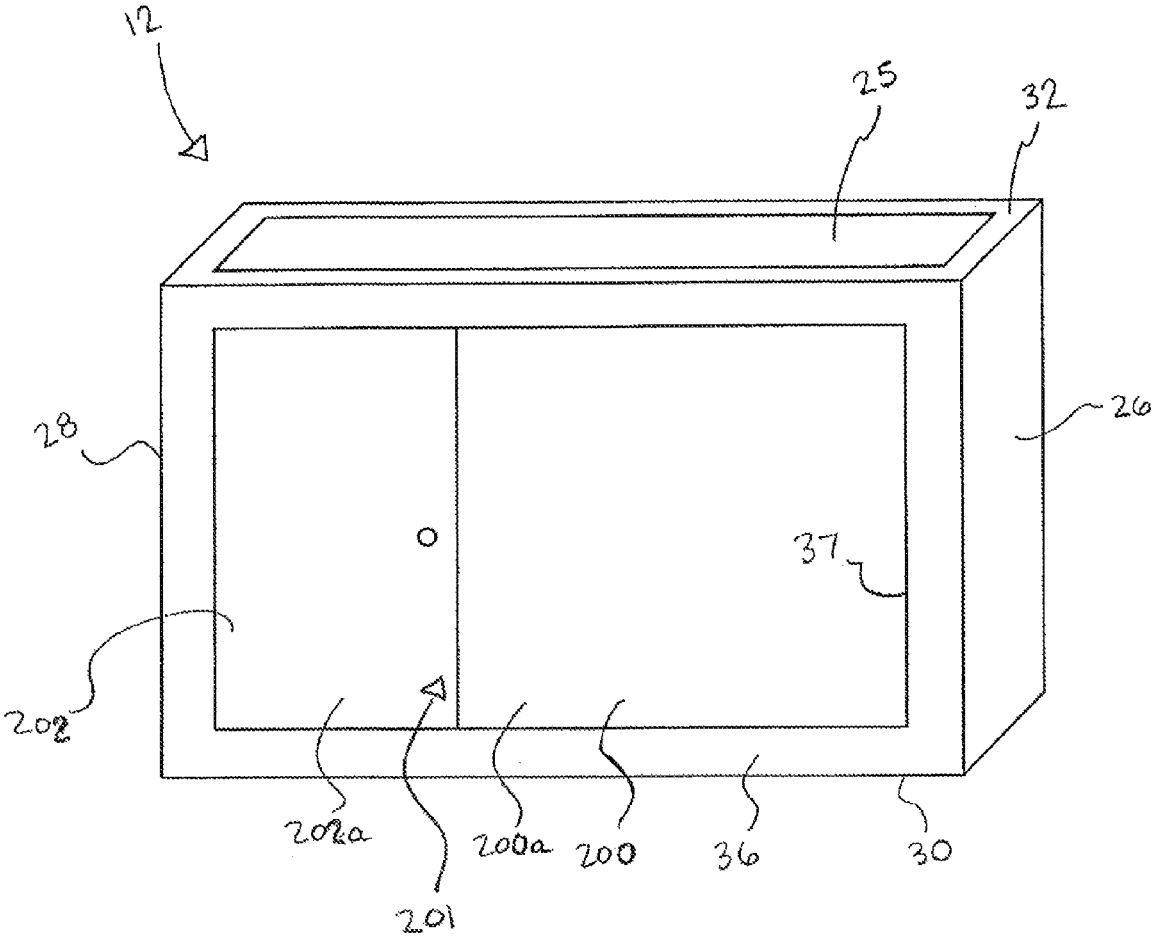
FIG. 3 is a perspective rear view of the enclosure showing a pair of panels mounted thereon.
Figure 4:
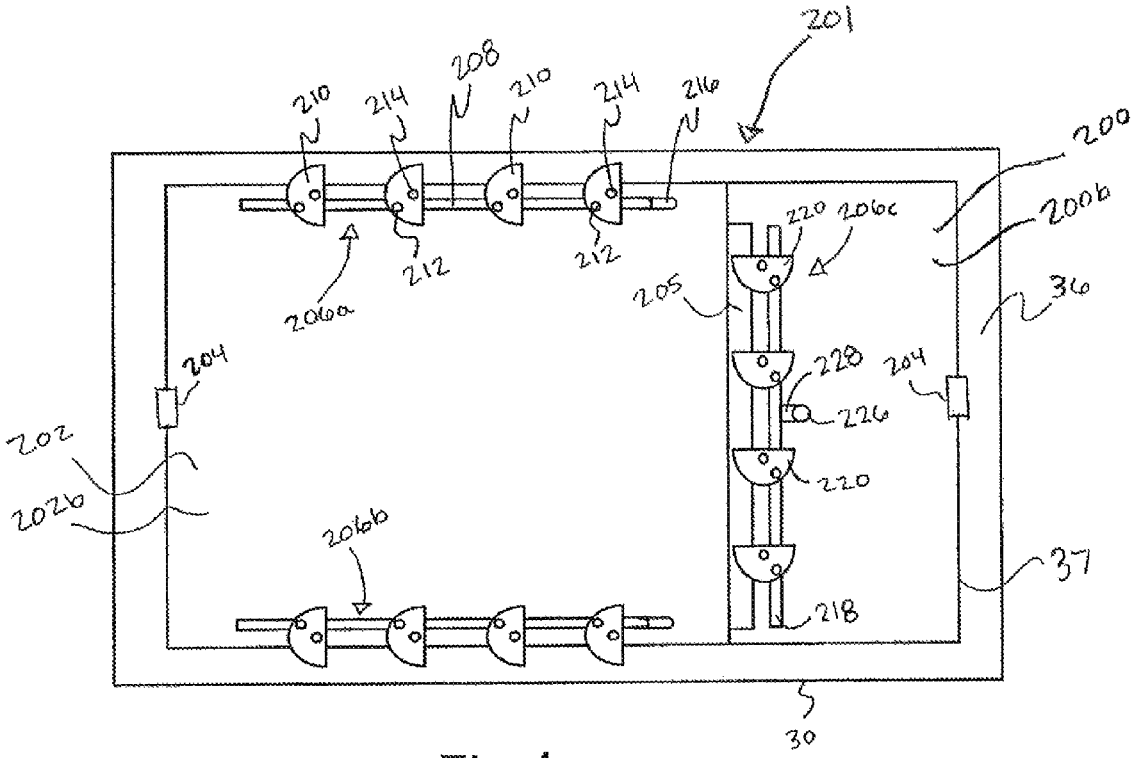
FIG. 4 is a rear view of the panels in a closed and locked position as viewed from within the enclosure of the display case.
Figure 5:
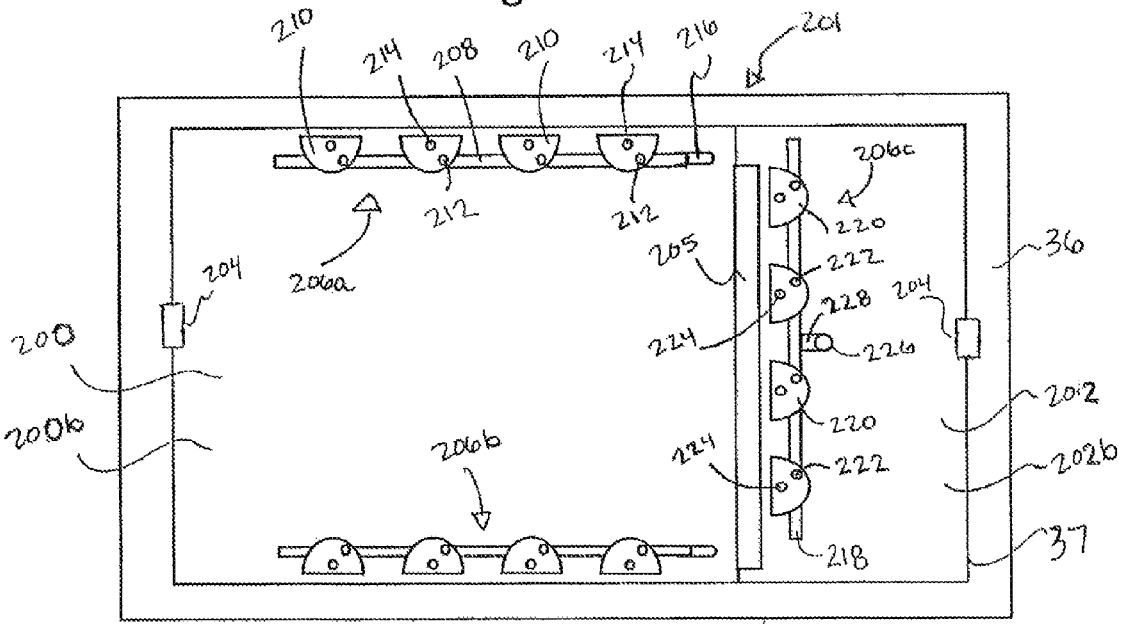
FIG. 5 is a rear view of the panels similar to that as shown in FIG. 4, but in an unlocked position.

As shown in FIGS. 3-5, means 201 for accessing the safe portion 14 of the enclosure 12 includes at least a pair of opposed panels 200, 202. The panels 200, 202 are hingedly movable about a substantially rectangular opening 37 formed in the back wall 36 of the enclosure 12 such that the panels 200, 202 open outwardly to provide access to the safe portion 14 and close to conceal the opening 37. The dimensions of the opening 37 formed in the back wall 36 are slightly smaller than that of the combined panels 200, 202 such that the closing of the panels 200, 202 is limited so as to not enter the safe portion 14. While only a single first panel 200, having a front surface 200*a* and a back surface 200*b*, and a single second panel 202, having a front surface 202*a* and a back surface 202*b*, are illustrated, any number of panels may be disposed on any number of walls on the enclosure 12 to provide various access points to the safe portion 14.

As shown in FIGS. 4 and 5, both the first panel 200 and the second panel 202 are hingedly attached to the back wall 36 of the enclosure 12 by a pair of hinges 204. It is to be understood that any number of hinges 204 may be utilized in order to allow the panels 200, 202 to sufficiently swivel open when unlocked. Preferably, the hinges 204 are disposed within the safe portion 14 of the enclosure 12 within the safe portion 14 so that the hinges 204 are not accessible from the outside, thus preventing them from being tampered with.

The first panel 200 includes a flange 205 extending laterally outward from a side of the first panel 200 opposite that of the hinge 204. The flange 205 provides a flat surface for the second panel 202 to abut against when closed. This creates a flush seal between the panels 200, 202 when closed against the opening 37 formed in the back wall 36. The flange 205 also provides an extended surface for the second panel 202 to lock against, as discussed below.

The panels 200, 202 each include at least one locking mechanism 206*a*, 206*b*, 206*c* similar to the locking assembly 58 and the locking assembly disclosed in co-pending U.S. patent application Ser. No. 15/016,901 with regards to locking the display housing 18 within the safe portion 14.

Here, at least one locking mechanism 206*a* is mounted on the back surface 200*b* of the first panel 200. Preferably, a pair of locking mechanisms 206*a*, 206*b* are utilized, one locking mechanism 206*a* disposed proximate an upper edge of the first panel 200 and the other locking mechanism 206*b* disposed proximate a lower edge of the first panel 200, both proximate the edge of the opening 37 of the back wall 36. Each locking mechanism 206*a*, 206*b* comprises the same structure and, therefore, only one locking mechanism 206*a* will be discussed in detail.

The locking mechanism 206*a* comprises an elongated shaft 208 and at least one disc 210 pivotally connected to the shaft 208 about a shaft pivot 212. Preferably, the locking mechanism 206*a* comprises a plurality of spaced apart discs 210 pivotally connected to the shaft 208, each at an associated shaft pivot 212. Each of the discs 210 are rotatably connected to the back surface 200*b* of the first panel 200 about a disc pivot 214. Therefore, as the shaft 208 is shifted from side to side and rotates the discs 210, the discs 210 maintain a central axis of rotation about an associated disc pivot 214. The shaft pivot 212 and disc pivot 214, preferably, comprises means for fastening such as a rivet, bolt, screw, and the like.

As the shaft 208 is translated horizontally and the discs 210 rotate, the discs 210 extend and retract over a portion of the back wall 36 of the enclosure 12. FIG. 4 shows the discs 210 in their extended and locked position overlapping a portion of the back wall 36 while FIG. 5 shows the discs 210 retracted and in an unlocked position. In order to facilitate horizontal translation of the shaft 208 from side to side, the shaft 208 includes a thumb tab 216 disposed on an end of the shaft 208 proximate the flange 205.

With regards to the second panel 202, a similar locking mechanism 206*c* to that of the locking mechanisms 206*a*, 206*b* is mounted on the rear surface 202*b* of the second panel 202. The locking mechanism 206*c* includes a shaft 218 and at least one disc 220 pivotally connected to the shaft 218 at a shaft pivot 222. Preferably, a plurality of discs 220 are employed and rotatably connected to the rear surface 202*b* of the second panel 202 at an associated disc pivot 224 proximate the flange 205.

The second panel 202 further includes a lock cylinder 226 for facilitating the locking and unlocking of the locking mechanism 206*c* from outside of the enclosure 12. The lock cylinder 226 can comprise any suitable mechanism such as a key-operated lock, mechanical switch, and the like. A linkage member 228 interconnects the lock cylinder 226 to the shaft 218. Preferably, the lock cylinder 226 is key-operated and operation of the lock cylinder 226 translates the shaft 218 either up or down, thereby rotating the discs 220 over the flange 205.

In order to lock the first and second panels 200, 202 against the opening 37 in the back wall 36 of the enclosure 12, a user first closes the first panel 200 and reaches within the safe portion 14 of the enclosure 12 to move the shaft 208 by pushing the thumb tab 216 inwardly. Where a second locking mechanism 206*b* is employed, the user similarly pushes the thumb tab of that shaft inwardly as well. This movement rotates the discs 210 upwardly and overlaps a portion of the back wall 36 in order to lock the first panel 200 and prevent it from swinging open.

Once the first panel 200 is locked in place, the user then closes the second panel 202. A key is inserted into the lock cylinder 226 and turned in a first direction, thereby rotating the lock cylinder 226 in a corresponding direction. This translates the shaft 218 downwardly and rotates the discs 220 behind the flange 205 in order to lock the second panel 202 in place.

In order to unlock the panels 200, 202 and access the safe portion 14 of the enclosure 12, the above steps are followed in the reverse order. The second panel 202 is first unlocked by rotating the lock cylinder 226 in a second direction. This translates the shaft 218 upwardly, which rotates the discs 220 away from the flange 205, thereby unlocking the second panel 202 from the first panel 200. Thereafter, the user may reach into the enclosure 12 through the open second panel 202 and pull the thumb tab 216 of the shaft 208 in the opposite direction in order to rotate the discs 210 away from the back wall 36 of the enclosure. The first panel 200 is then free to swing open. As noted above, the locking mechanisms 206*a*, 206*b*, 206*c* illustrated in FIGS. 3-5 are the significant improvements from the above co-pending applications.

Turning to FIGS. 6-11, the display case 10 includes a locking assembly 58, similar in structure to the locking mechanisms 206*a*, 206*b*, 206*c*, for locking the display housing 18 to the enclosure 12 when the display housing 18 is in the security position.

In a preferred embodiment, the locking assembly 58 is mounted within the safe portion 14 on the upper wall 32 of the enclosure 12. As shown, a pair of locking assemblies 58, 58' is used wherein each locking assembly 58, 58' is mounted on opposite sides of the opening 25 formed within the top wall 32 of the enclosure 12. Each locking assembly 58, 58' has a plurality of discs 64, the plurality of discs 64 being adapted to rotate about a vertical axis between an unlocked and locked position.

Figure 6:
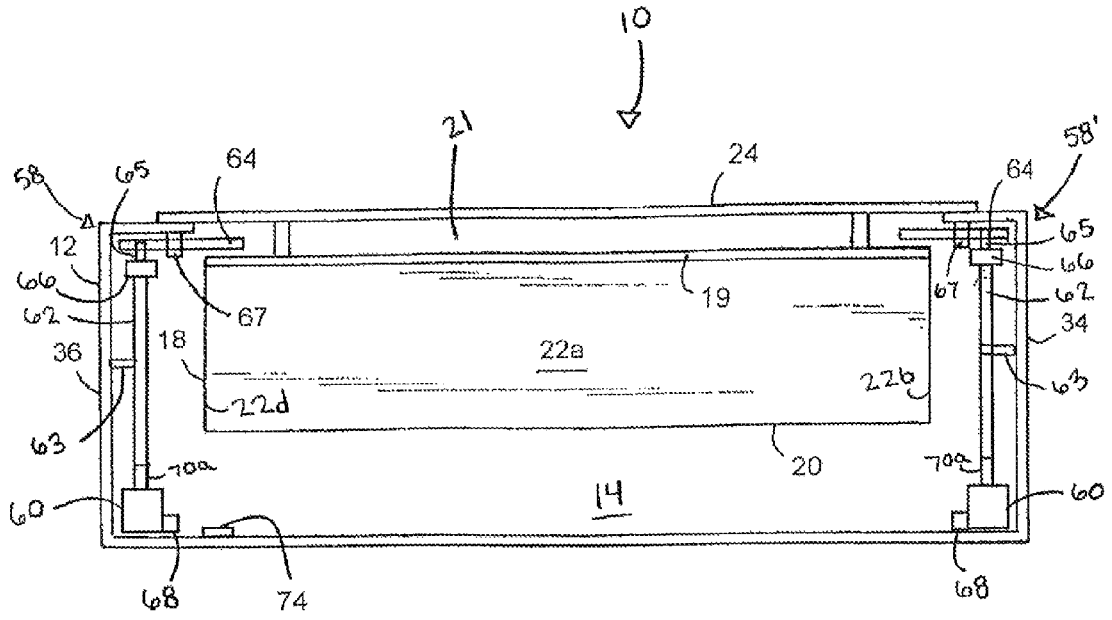
FIG. 6 is a partial cross-sectional end view of the display case illustrating the display case when the display housing is lowered into the safe portion and at least one disc in an extended position.
Figure 8:
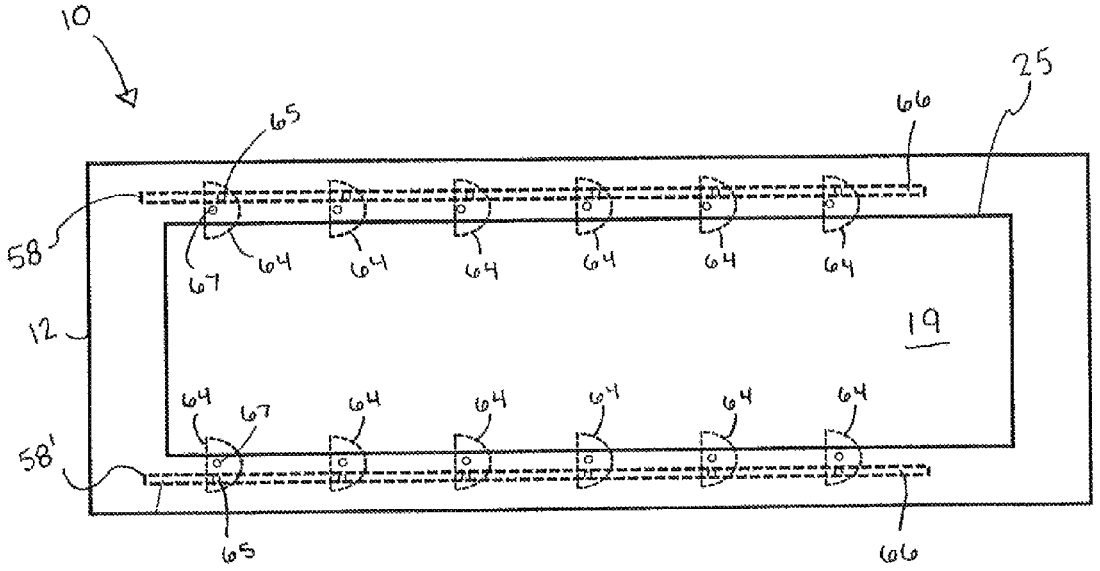
FIG. 8 is a top view of the display case without an attached closure member showing a plurality of discs in the extended position and the display housing locked in the safe portion of the enclosure.
Figure 9:
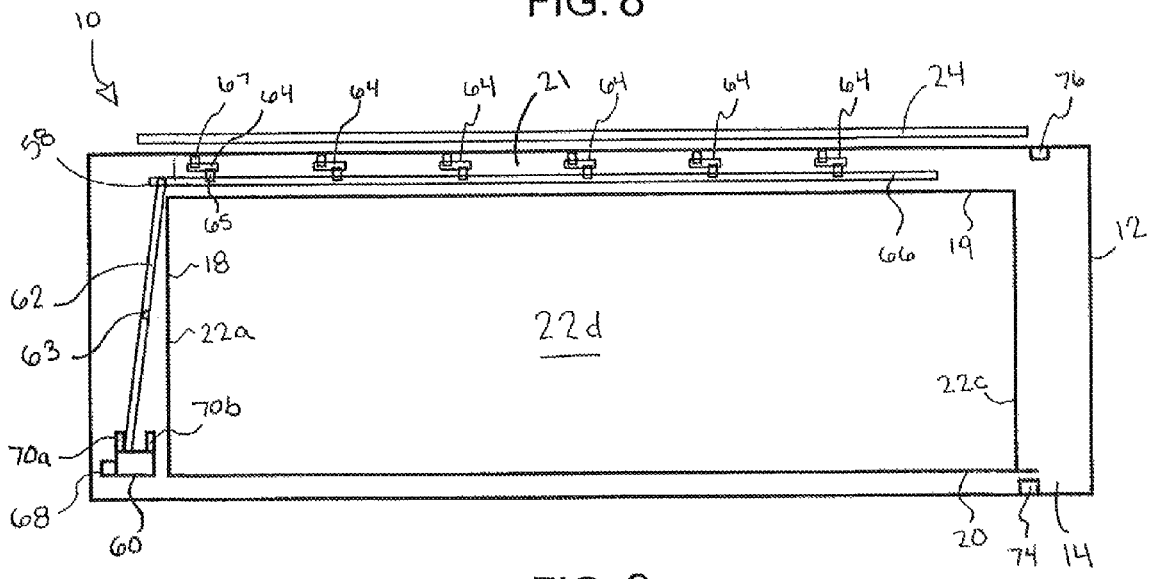
FIG. 9 is a partial cross-sectional front view showing the plurality of discs in the extended position within a gap provided between a top wall of the display housing and the closure member.

Each locking assembly 58, 58' further includes a rod 66, each disc 64 being rotatably connected to the rod 66 and adapted to be rotatably extended and retracted. As shown in FIGS. 6, 8, and 9, in the extended position, each disc 64 is rotated, as discussed below, and positioned within the gap 21 provided between the top wall 19 of the display housing 18 and the above mounted closure member 24, thereby locking the display housing 18 within the safe portion 14 of the enclosure 12.

Figure 7:
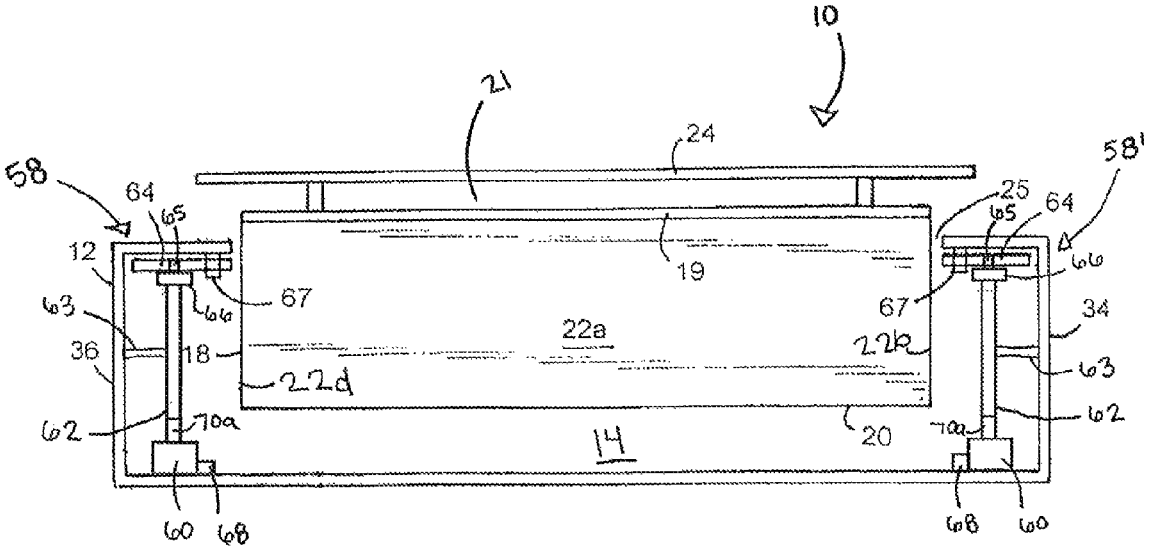
FIG. 7 is a view similar to FIG. 6, but showing the at least one disc in a retracted position and the display housing partially raised.
Figure 10:
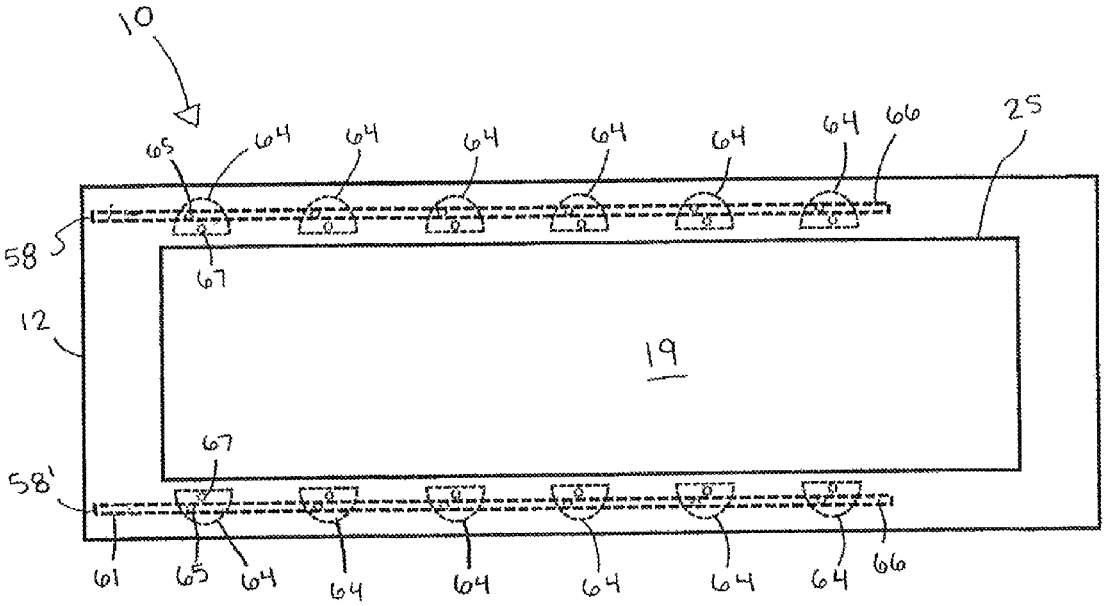
FIG. 10 is a top view of the display case without the closure member showing the plurality of discs in the retracted position and the display housing unlocked in the safe portion.
Figure 11:
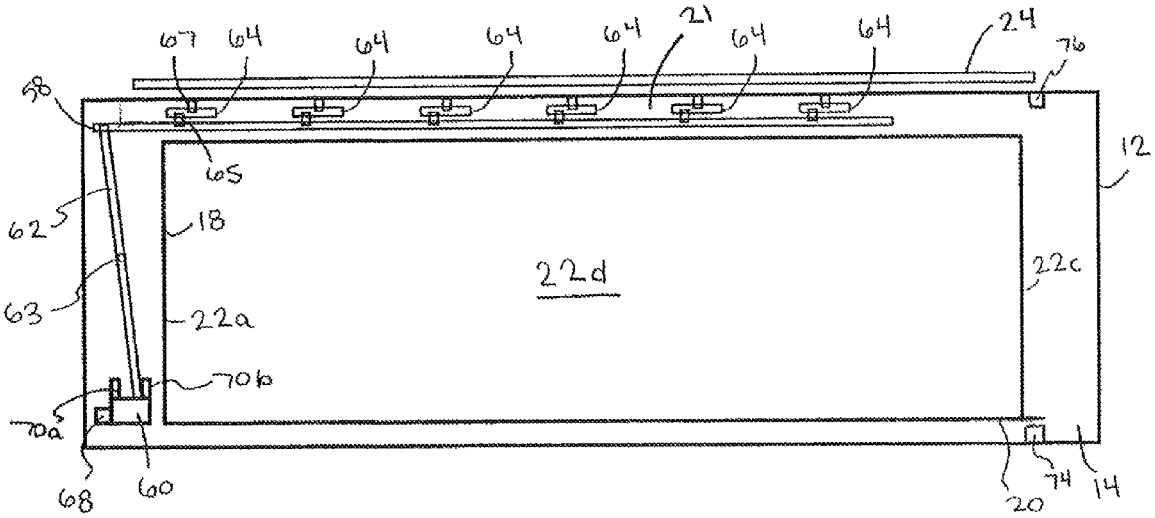
FIG. 11 is a partial cross-sectional front view showing the plurality of discs in the retracted position.

As shown in FIGS. 7, 10, and 11, in the retracted position, each disc 64 is rotated and positioned outside of the gap 21, thereby unlocking the display housing 18 from the safe portion 14.

Each locking assembly 58, 58' further includes a locking member 60 mounted within the enclosure 12 and an upwardly extending, elongated lever 62 disposed within the safe portion 14 pivotally attached to the locking member 60, the lever 62 being rotatably connected to the rod 66. The locking member 60 further includes an unlock trip switch 70*a* and a lock trip switch 70*b* disposed on the locking member 60. A second drive motor 68 drives the locking member 60.

As opposed to the locking assembly disposed proximate the top wall of the enclosure as disclosed in co-pending U.S. patent application Ser. No. 14/966,092, here, the locking member 60, along with the second drive motor 68 and trip switches 70*a*, 70*b*, are disposed proximate the lower wall 30 of the enclosure 12 to provide ease of access when the panels 200, 202 of the enclosure 12 are opened. To facilitate rotation of the discs 64 via the distally disposed locking member 60, the lever 62 is elongated and upwardly extending in order to interconnect the locking member 60 and rod 66. Due to the elongated structure of the lever 62, a lever pivot 63 rotatably connects the lever 62 to either the front or back wall 22*b*, 22*d* of the enclosure 12 in order to facilitate pivoting of the lever 62 by the locking member 60.

The second drive motor 68 is in operable driving relation to the lever 62 and in electrical communication to the trip switches 70*a*, 70*b*. Energization of the second drive motor 68 operates to pivot the lever 62 about the locking member 60 such that the rod 66 extends or retracts based on the operation of the second drive motor 68.

As each disc 64 is pivotally fixed to the enclosure 12 at an enclosure pivot 67 and pivotally fixed to the rod 66 at a rod pivot 65, the extension and retraction of the rod 66 causes each disc 64 to rotate outwardly and inwardly, respectively. It is to be understood that the configuration of the lever 62, rod 66, and each disc 64 may be modified such that each disc 64 rotates in opposite directions based on the movement of the lever 62 and rod 66.

A control system controls each locking assembly 58, 58' and the lift mechanism. The control system includes an actuator switch 72, the first and second drive motors 68, the trip switches 70*a*, 70*b*, and the limit switches 74, 76.

The actuator switch 72 is externally operated by a key and is initially in a "neutral position," but selectively positionable to either an "up" or a "down" position to energize the second drive motor 68 when the actuator switch 72 is positioned to the "up" position and the first drive motor when the actuator switch 72 is positioned to the "down" position.

The lower and upper limit switches 74, 76 are engaged by movement of the display housing 18. Engagement of either the lower or upper limit switch 74, 76 by the display housing 18 will cause the first drive motor to de-energize and position the display housing 18 in either the security or display positions. Similarly, the lock and unlock trip switches 70*a*, 70*b* are engaged by movement of the lever 62. Engagement of either the lock or unlock trip switches 70*a*, 70*b* by the lever 62 will cause the second drive motor 68 to de-energize and position each disc 64 in either the lock or unlock positions.

Preferably, the unlock trip switch 70*b* is in electrical communication with the first drive motor such that when the unlock trip switch 70*b* is engaged by the lever 62, and each disc 64 in the unlocked position, the second drive motor 68 is de-energized and the first drive motor is energized, thereby lifting the display housing 18. Similarly, it is preferred that the lower limit switch 74 is also in electrical communication with the second drive motor 68 such that when the lower limit switch 74 is engaged by the display housing 18, the first drive motor is de-energized and the second drive motor 68 is energized, thereby rotating each disc 64 and locking the display housing 18 within the enclosure 12. Configuring the trip switches 70*a*, 70*b* and limit switches 74, 76 as noted above, ensures that the first and second drive motors do not burn out from operating past the threshold and, additionally, that the first and second drive motors do not operate simultaneously. Otherwise, it would cause the lift mechanism and each locking assembly 58, 58' to operate at the same time while the display housing 18 is not in an appropriate position.

Where the display housing 18 is locked in the safe portion 14, movement of the actuator switch 72 to the "up" position energizes the second drive motor 68 and causes each disc 64 to retract from their position within the gap 21 between the top wall 19 of the display housing 18 and the closure member 24. This unlocks the display housing 18 from the enclosure 12. Once each disc 64 is fully retracted via the rod pivot 65 and the enclosure pivot 67, the lever 62 engages the unlock trip switch 70*b*, the second drive motor 68 is de-energized, and the first drive motor is energized. The first drive motor effectuates movement of the display housing 18 upward and away from the lower limit switch 74. Ultimately, the display housing 18 engages the upper limit switch 76 whereupon a signal is sent to de-energize the first drive motor and position the display housing 18 in the display position.

The above process is reversed when the user wishes to place the display housing 18 in locked relation within the safe portion 14. The actuator switch 72 is turned to the "down" position whereupon electrical signals are sent to the first drive motor. The display housing 14 is lowered into the enclosure 16 and, upon the display housing 18 engaging the lower limit switch 74, the first drive motor is de-energized and the second drive motor 68 is energized. Upon the second drive motor 68 being energized, the lever 62 pivots in order to retract the rod 66 and rotate each disc 64 into locking engagement within the gap 21 between the top wall 19 of the display housing 18 and the closure member 24. Once each disc 64 is fully rotated outwardly via the rod pivot 65 and the enclosure pivot 67, the lever 62 engages the lock trip switch 70*a* and the second drive motor 68 is de-energized.

LIST OF REFERENCE NUMBERS

10 Display case
12 Enclosure
14 Safe portion
18 Display housing
19 Top wall of display housing
20 Lift platform
21 Gap
22*a* Sidewall of display housing
22*b* Front wall of display housing
22*c* Sidewall of display housing
22*d* Back wall of display housing
24 Closure member of display housing
25 Central opening of top wall
26 Sidewall of enclosure
28 Sidewall of enclosure
30 Lower wall of enclosure
32 Upper wall of enclosure
34 Front wall of enclosure
36 Back wall of enclosure
37 Opening in back wall
58 Locking assembly
58' Locking assembly
60 Locking member

62 Lever
63 Lever pivot
64 Disc
65 Rod pivot
66 Rod
67 Enclosure pivot
68 Second drive motor
70*a* Lock trip switch
70*b* Unlock trip switch
72 Actuator switch
74 Lower limit switch
76 Upper limit switch
200 First panel
200*a* Front surface of first panel
200*b* Back surface of first panel
201 Means for accessing the safe portion
202 Second panel
202*a* Front surface of second panel
202*b* Back surface of second panel
204 Hinges
206*a* Locking mechanism
206*b* Locking mechanism
206*c* Locking mechanism
208 Shaft
210 Disc
212 Shaft pivot
214 Disc pivot
216 Thumb tab
218 Shaft
220 Disc
222 Shaft pivot
224 Disc pivot
226 Lock cylinder
228 Linkage member

Having thus described the invention, what is claimed is:

1. A security display case comprising:

(a) an enclosure, the enclosure comprising a pair of laterally spaced sidewalls, an upper wall, a lower wall, a front wall, and a back wall, the back wall including an opening formed therein permitting access to the safe portion, the upper wall, lower wall, front wall, and back wall extending between the pair of sidewalls to define a lower safe portion, a central opening formed in the upper wall;

(b) at least a pair of panels hingedly attached to the back wall over the opening formed therein, the at least a pair of panels comprising a first panel and a second panel, the first and second panels each having a front surface and a back surface, at least one first locking mechanism disposed on the back surface of the first panel, a second locking mechanism disposed on the back surface of the second panel, a lock cylinder formed within the second panel for facilitating operation of the second locking mechanism;

(c) a display housing, the display housing moveable into and out of the safe portion of the enclosure through the central opening formed therein, the display housing having a pair of laterally spaced sidewalls, a top wall, a lower lift platform, a front wall, and a back wall, the top wall, lift platform, front wall, and back wall extending between the pair of sidewalls, at least one of the walls at least partially transparent, and a closure member mounted distally above the top wall providing a gap therebetween;

(d) at least one locking assembly, the locking assembly being mounted within the enclosure, the locking assembly comprising a locking member disposed proximate the lower wall of the enclosure, an upwardly extending lever having a first end and a second end, the first end of the lever pivotally connected to the locking member, a rod rotatably connected to the second end of the lever opposite the locking member, at least one disc rotatably connected to the rod and the enclosure, wherein the at least one disc rotatably extends into and retracts out of the gap provided between the top wall and the closure member of the display housing as the lever pivots about the locking member and the rod retracts and extends, respectively, a second drive motor disposed proximate the lower wall of the enclosure in electrical communication with the locking member, a pair of trip switches in electrical communication with the second drive motor to de-energize the second drive motor when necessary; and (e) a control system, the control system in communication with the second drive motor to facilitate rotation of the at least one disc, thereby locking and unlocking the display housing within the safe portion of the enclosure.

2. The security display case of claim 1 further comprising a plurality of discs rotatably connected and disposed along the rod of the locking assembly.

3. The security display case of claim 1 further comprising a pair of opposed locking assemblies each being mounted within the enclosure proximate the central opening.

4. The security display case of claim 1, wherein the at least one first locking mechanism further comprises a horizontally translatable shaft and at least one disc pivotally connected thereto, the at least one disc being rotatably connectable to the back surface of the first panel, wherein the at least one disc rotatably extends and retracts behind a portion of the back wall as the shaft translates horizontally.

5. The security display case of claim 4 further comprising a thumb tab disposed on an end of the shaft of the at least one first locking mechanism proximate the second panel to facilitate manual horizontal translation of the shaft.

6. The security display case of claim 4 further comprising a plurality of discs pivotally connected and disposed along the shaft of the at least one first locking mechanism.

7. The security display case of claim 4 further comprising a pair of first locking mechanisms mounted opposite each other on the back surface of the first panel proximate upper and lower ends of the first panel.

8. The security display case of claim 1, wherein the second locking mechanism further comprises a vertically translatable shaft and at least one disc pivotally connected thereto, the shaft pivotally connected to the lock cylinder, the at least one disc being rotatably connectable to the back surface of the second panel, wherein the at least one disc rotatably extends and retracts over a portion of the first panel thereby locking the first and second panels in place.

9. The security display case of claim 8 further comprising a plurality of discs pivotally connected and disposed along the shaft of the second locking mechanism.

10. The security display case of claim 1 wherein the sidewalls, the upper wall, the lower wall, the front wall, and the back wall are opaque.

11. In a display case of the type having at least a pair of opposed lockable panels, the at least a pair of panels comprising a first panel and a second panel, the first and second panels each having a front surface and a back surface, the improvement comprising:

(a) at least one first locking mechanism disposed on the back surface of the first panel, the at least one first locking mechanism including a horizontally translatable shaft and at least one disc pivotally connected thereto, the at least one disc being rotatably connectable to the back surface of the first panel, wherein the at least one disc rotatably extends and retracts behind a portion of the back wall as the shaft translates horizontally;

(b) a second locking mechanism disposed on the back surface of the second panel, the second locking mechanism including a vertically translatable shaft and at least one disc pivotally connected thereto, the at least one disc being rotatably connectable to the back surface of the second panel, wherein the at least one disc rotatably extends and retracts over a portion of the first panel as the shaft translates vertically thereby locking the first and second panels in place; and (c) a lock cylinder formed within the second panel for facilitating vertical translation of the second locking mechanism, the lock cylinder pivotally connected to the shaft of the second locking mechanism; and wherein the first and second locking mechanisms are independently movable with respect to each other.

12. The improvement of claim 11 further comprising a thumb tab disposed on an end of the shaft of the at least one first locking mechanism proximate the second panel to facilitate manual horizontal translation of the shaft.

13. The improvement of claim 11 further comprising a plurality of discs pivotally connected and disposed along the shaft of the at least one first locking mechanism.

14. The improvement of claim 11 further comprising a pair of first locking mechanisms mounted opposite each other on the back surface of the first panel proximate upper and lower ends of the first panel.

15. The improvement of claim 11 further comprising a plurality of discs pivotally connected and disposed along the shaft of the second locking mechanism.

16. A locking mechanism comprising:

(a) at least one first locking mechanism including a horizontally translatable shaft and at least one disc pivotally connected thereto, the at least one disc being rotatably connectable to a surface, wherein the at least one disc rotatably extends and retracts as the shaft translates horizontally;

(b) a second locking mechanism including a vertically translatable shaft and at least one disc pivotally connected thereto, the at least one disc being rotatably connectable to a surface, wherein the at least one disc rotatably extends and retracts over a portion of the first panel as the shaft translates vertically; (c) a lock cylinder pivotally connected to the shaft of the second locking mechanism for facilitating vertical translation of the shaft; and wherein the first and second locking mechanisms are independently movable with respect to each other.

17. The locking mechanism of claim 16 further comprising a thumb tab disposed on an end of the shaft of the at least one first locking mechanism to facilitate manual horizontal translation of the shaft.

18. The locking mechanism of claim 16 further comprising a plurality of discs pivotally connected and disposed along the shaft of the at least one first locking mechanism.

19. The locking mechanism of claim 16 further comprising a pair of distally spaced first locking mechanisms.

20. The locking mechanism of claim 16 further comprising a plurality of discs pivotally connected and disposed along the shaft of the second locking mechanism.

* * * * *